US005989306A

United States Patent [19]

Rioja et al.

[11] Patent Number: 5,989,306

[45] Date of Patent: Nov. 23, 1999

[54] METHOD OF MAKING A METAL SLAB WITH A NON-UNIFORM CROSS-SECTIONAL SHAPE AND AN ASSOCIATED INTEGRALLY STIFFENED METAL STRUCTURE USING SPRAY CASTING

[75] Inventors: Roberto J. Rioja, Murrysville; Frank W. Baker, Lower Burrell, both of Pa.

[73] Assignee: Aluminum Company of America, Pittsburgh, Pa.

[21] Appl. No.: 08/914,925

[22] Filed: Aug. 20, 1997

[51] Int. Cl.[6] ..... B22F 9/00

[52] U.S. Cl. ..... 75/338; 164/46

[58] Field of Search ..... 164/46; 75/338

[56] References Cited

U.S. PATENT DOCUMENTS

| | | | |
|---|---|---|---|
| 3,909,921 | 10/1975 | Brooks | 164/46 |
| 4,650,618 | 3/1987 | Heinemann et al. | 164/461 |
| 4,865,117 | 9/1989 | Bartlett et al. | 164/479 |
| 5,126,529 | 6/1992 | Weiss et al. | 164/46 |
| 5,174,363 | 12/1992 | Furo et al. | 164/476 |
| 5,226,948 | 7/1993 | Orme et al. | 75/338 |
| 5,268,018 | 12/1993 | Mourer et al. | 164/46 |
| 5,348,075 | 9/1994 | Perry et al. | 164/476 |

FOREIGN PATENT DOCUMENTS

| | | | |
|---|---|---|---|
| 1-312013 | 12/1989 | Japan | 164/46 |
| 1472939 | 5/1977 | United Kingdom . | |

*Primary Examiner*—George Wyszomierski
*Attorney, Agent, or Firm*—Benjamin T. Queen II; David V. Radack; Gary P. Topolosky

[57] ABSTRACT

A method of making a metal slab with a non-uniform cross-sectional shape including providing a spray casting apparatus including a substrate and a plurality of spaced atomization nozzles, the nozzles having a discharge opening and introducing molten metal into the nozzles. The method then includes atomizing the molten metal as it is discharged from the nozzles through the discharge openings by subjecting the discharged molten metal to jets of an atomizing gas in order to form metal droplets for deposition onto the substrate. The deposition of the metal droplets onto the substrate is controlled in order to form the metal slab having a non-uniform cross-sectional shape. A method of making an integrally stiffened metal structure as well as metal and aluminum products made by the above methods are also provided.

22 Claims, 3 Drawing Sheets

METHOD OF MAKING A METAL SLAB WITH A NON-UNIFORM CROSS-SECTIONAL SHAPE AND AN ASSOCIATED INTEGRALLY STIFFENED METAL STRUCTURE USING SPRAY CASTING

BACKGROUND OF THE INVENTION

This invention relates to a method of making a metal slab with a non-uniform cross-sectional shape and an associated integrally stiffened metal structure using spray casting.

Metal products for use as fuselages for aircrafts, reinforced skins for space vehicles, integrally stiffened sheet for trains or transportation vehicles and heat exchangers can have a flat portion with ribs extending from the flat portion. These metal products can be made by attaching the upstanding ribs to a flat rolled product by a variety of joining methods such as riveting, fastening, bonding or welding. However, a disadvantage of this process is that joining places are sources of failure. A further disadvantage is that this process requires a separate joining operation and the need for inspection.

There are known methods of making an integrally stiffened structure. One known method involves extrusion. Another known method involves machining a metal piece to form the integrally stiffened structure. Both of these methods have inherent disadvantages, the most prominent of which is the high cost of producing the integrally stiffened structure.

Thus, there remains a need for making a metal slab with a non-uniform cross-sectional shape which can then be worked, such as by shaped hot rolling, into an integrally stiffened metal structure. The method should produce a metal structure having excellent structural characteristics while at the same time reducing the costs and inefficiencies associated with known prior art methods.

SUMMARY OF THE INVENTION

The invention has met or exceeded the above-mentioned needs as well as others. A method of making a metal slab with a non-uniform cross-sectional shape comprises providing a spray casting apparatus including a substrate and a plurality of spaced atomization nozzles, the nozzles having a discharge opening and introducing molten metal into the nozzles. The method then comprises atomizing the molten metal as it is discharged from the nozzles through the discharge openings by subjecting the discharged molten metal to jets of an atomizing gas in order to form metal droplets for deposition onto the substrate. The deposition of the metal droplets onto the substrate is controlled in order to form the metal slab having a non-uniform cross-sectional shape.

A method of making an integrally stiffened metal structure is also provided. In this method, a metal slab with a non-uniform cross-sectional shape is made substantially as set forth above. The metal slab is then worked to form the integrally stiffened metal structure. The working is preferably done by shaped hot rolling. A metal product made by the above method as well as an aluminum product made by the above method are also provided.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
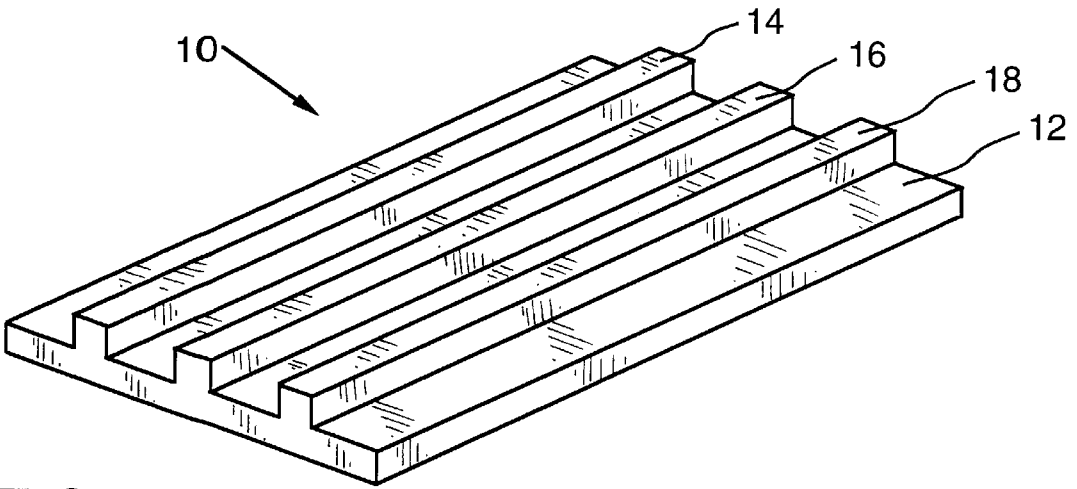
FIG. 1 is a perspective view of an integrally stiffened metal structure that can be made using the method of the invention.

Referring now particularly to FIG. 1, a perspective view of an integrally stiffened metal structure 10 made by the method of the invention is shown. The structure 10 consists of a flat portion 12 having three integrally formed ribs 14, 16, 18 which extend generally perpendicularly from the flat portion 12. The structure is made of metal such as steel or aluminum and their alloys by spray casting as will be explained below. The metal structure can be used for many different purposes, among which are fuselages for aircrafts; reinforced skins for space vehicles structures; integrally stiffened sheet for trains or transportation vehicles; or heat exchangers.

Figure 2:
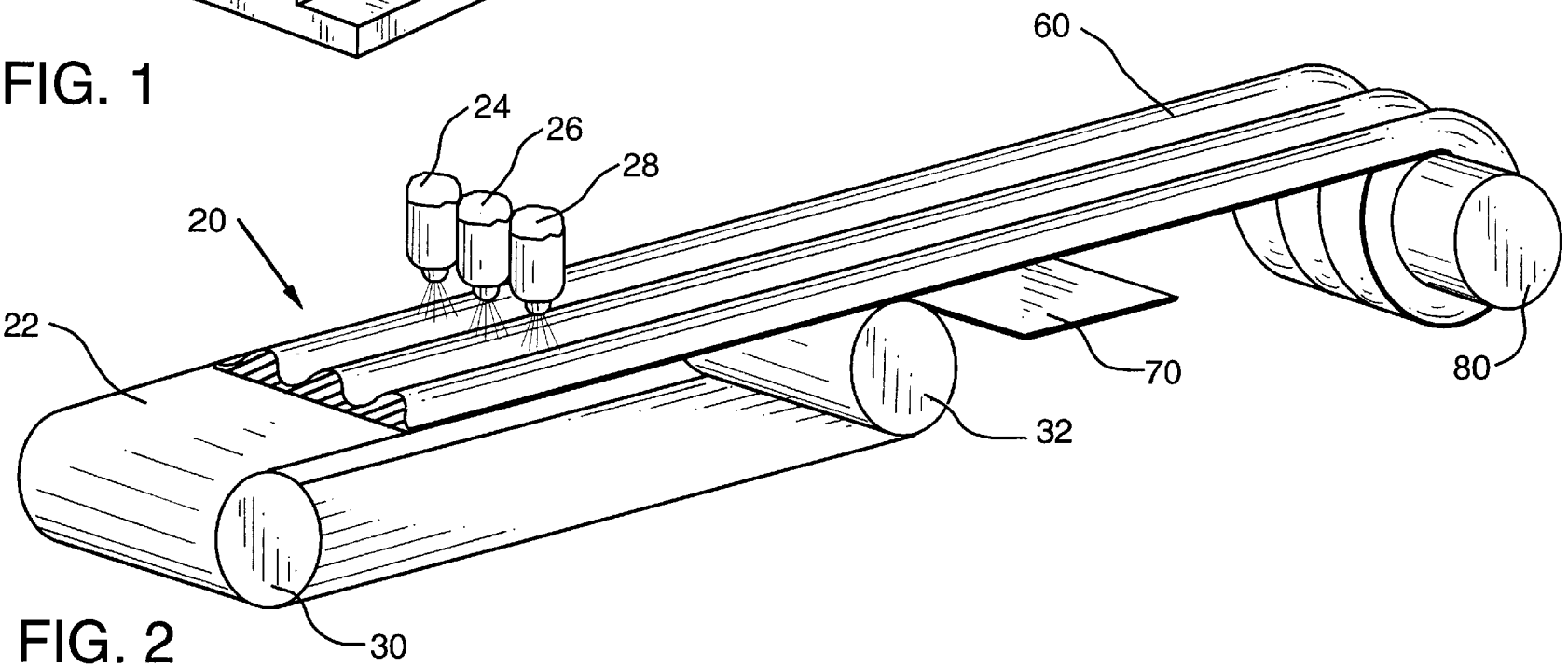
FIG. 2 is a partially schematic perspective view of a spray casting apparatus that can be used to make the metal slab with a non-uniform cross-sectional shape of the invention.

In accordance with the invention, the structure 10 is made by spray casting to form a metal slab having a non-uniform cross-sectional shape and then working, preferably by shaped hot rolling, the slab to form the integrally stiffened metallic structure 10. Referring now to FIG. 2, the method of making the metal slab will now be discussed.

Figure 3:
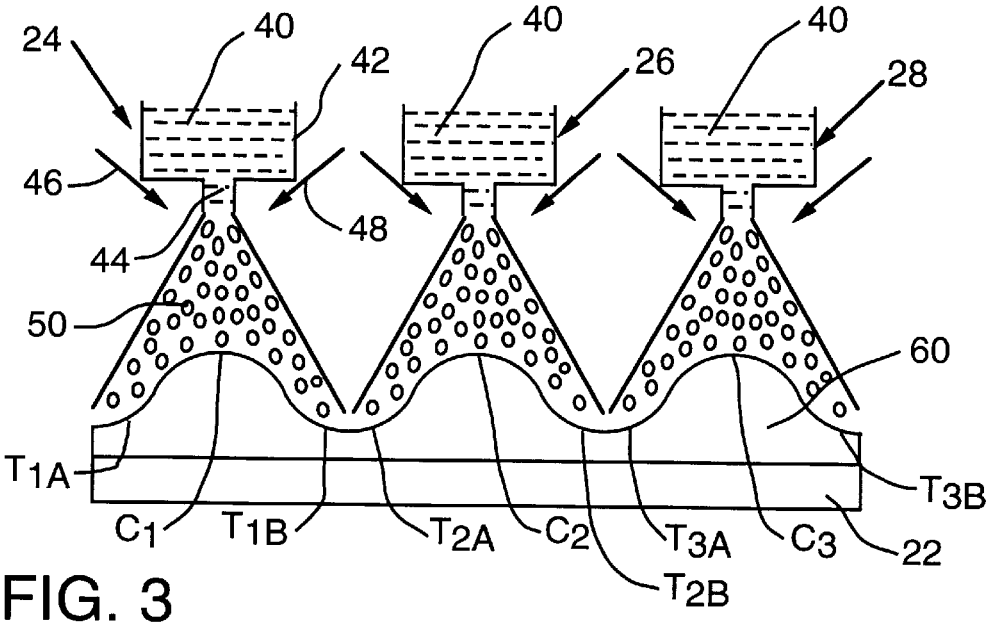
FIG. 3 is a detailed cross-sectional view of the nozzles of the spray casting apparatus showing the deposition of the metal droplets on the substrate.

FIG. 2 shows a spray casting apparatus 20 which consists of a movable substrate 22 and a plurality of atomizing spray nozzles with three atomizing spray nozzles 24, 26 and 28. It will be appreciated that less than or more than three nozzles can be used depending upon the final shape of the structure that is desired. The nozzles 24, 26 and 28 are preferably (but not necessarily) disposed in a straight line transversely across the width of the substrate 22. Although not shown in FIG. 2, the nozzles 24, 26, 28 can be contained in an airtight vacuum chamber. The substrate 22, preferably made of metal, is shown as an endless belt which orbits two rollers, rollers 30 and 32. Referring now to FIG. 3, molten metal 40 is introduced into a crucible, such as crucible 42 of nozzle 24, and is discharged through a discharge opening, such as discharge opening 44 of nozzle 24. At the point of discharge, the molten metal is subject to jets of atomizing gas, preferably nitrogen or argon, such as jets 46 and 48. This creates metal droplets, such as metal droplet 50 which may eventually (depending on the interaction of the droplets discussed below) be deposited onto the substrate 22. The size of the metal droplets 50 are greatly exaggerated on FIG. 3 for purposes of illustration only. In practice, the metal droplets 50 will be generally spherical, having about a diameter of 1 to 500 $\mu$m.

As can be clearly seen from FIG. 3, the metal droplets are deposited onto the substrate by each of the nozzles in a gaussian, or normal distribution profile, with each deposit having a center $C_1$, $C_2$, $C_3$ and two tails $T_{1A}$, $T_{1B}$; $T_{2A}$, $T_{2B}$;

and $T_{3A}$, $T_{3B}$. It will be appreciated that adjacent tails $T_{1B}$ and $T_{2A}$; $T_{2B}$ and $T_{3A}$ overlap each other. As will be discussed below, the dimensions of these gaussian profiles can be controlled in order to form a metal slab having the proper dimensions and characteristics so that a desired integrally stiffened metal structure can be produced.

Once deposited, the metal slab 60 that is formed is moved away from the nozzles and is eventually removed from the substrate by providing a metal knife apparatus 70 (shown schematically in FIG. 2). The metal slab 60 can then be wound on a coil 80 which can then be transported to a further work station, such as a hot mill, as will be discussed further below.

Figure 4:
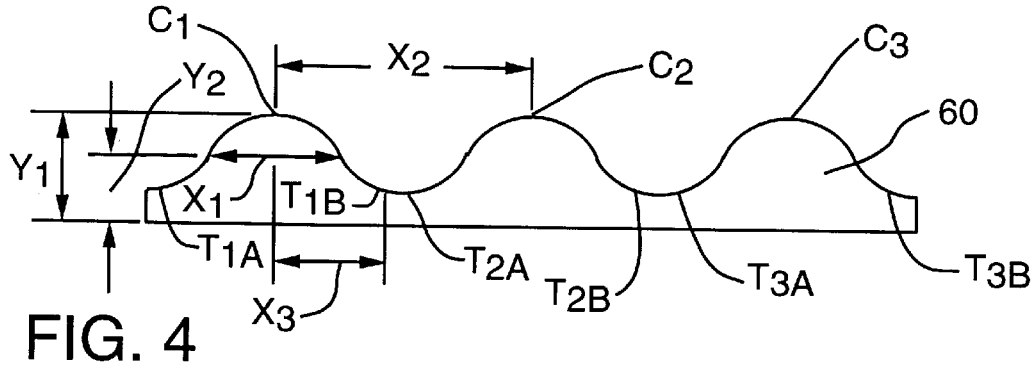
FIG. 4 is a sectional view of the metal slab of the invention showing the critical design dimensions thereof.

It will be appreciated that the deposition process, which involves atomizing the molten metal and depositing the metal droplets on the substrate, is the determining factor in the non-uniform cross-sectional shape of the metal slab. The cross-sectional shape of the metal slab must be controlled in order to produce the final cross-sectional shape of the integrally stiffened metal structure. Referring to FIG. 4, there is shown a cross-sectional view of the metal slab 60 showing some of the critical dimensions that must be controlled in order to eventually produce the desired integrally stiffened metallic structure. These dimensions include:

$y_1$—the height of a gaussian distribution $y_2$—one-half (½) of the height of a gaussian distribution $x_1$—the horizontal distance between (i) a point on the upward sloping portion of the gaussian distribution that is at height $y_2$ and (ii) a point on the downward sloping portion of the gaussian distribution that is at height $y_2$ $x_2$—the horizontal distance between the centers $C_1$ and $C_2$ of adjacent gaussian distributions $x_3$—the horizontal distance between the center $C_1$ and the approximate end point of the tail $T_{1B}$.

These dimensions will determine the final cross-sectional shape of the integrally stiffened metal structure. These dimensions are themselves determined by the deposition of the metal droplets on the substrate, which in turn are controlled by (i) the formation of the metal droplets at the discharge opening of the nozzle and (ii) the interaction of the metal droplets between the discharge opening and the substrate. As will be explained below, the formation and the interaction of the metal droplets are dependent upon, among other things (i) the temperature of the molten metal introduced into the nozzle; (ii) the pressure of the atomizing gas to which the discharged molten metal is subject; (iii) the rate at which the substrate moves; (iv) the dimension of the discharge opening; and (v) the positioning of the spray nozzles. In addition, the pressure and atmosphere in an atomizing chamber (not shown in FIG. 2) can also control the deposition of the metal droplets.

The temperature of the molten metal in the crucible effects the molten metal flow through the discharge opening. The hotter the molten metal, the less viscous it will be, thus leading to greater molten metal flow. This in turn will produce more metal droplets, thus increasing the height ($y_1$) of the metal slab. Conversely, cooler molten metal temperatures will produce a less viscous flow. Thus reducing the amount of molten metal droplets and thus creating a slab having a decreased height. The temperature ranges are defined by the liquidus/solidus temperature for a given aluminum alloy. The typical temperature range for a given aluminum alloy is between about 10° C. to 250° C. above the solidus temperature for that aluminum alloy.

The pressure of the atomizing gas affects the formation and interaction of the metal droplets. As the atomizing pressure increases, smaller metal droplets are produced which move at a greater speed towards the substrate. This has the effect of increasing the deposit height for a given substrate speed.

The rate of movement of the substrate will also affect the shape of the metal slab. The faster the substrate moves, the less metal droplets per unit area of substrate will be deposited. Typical linear substrate speeds are between about 10 ft/min to 170 ft/min. Similarly, the larger the dimension of the discharge opening the greater the amount of molten metal that is atomized thus leading to increased height of the gaussian distribution. Typical opening diameters are between about 0.02 inches to 0.35 inches.

Finally, the positioning of the spray nozzles will also affect the final cross-sectional shape of the metal slab. The nozzles can be adjusted to have a greater or lesser distance between the nozzle discharge opening and the substrate, as well as a greater or lesser horizontal distance between adjacent nozzles.

All of the above variables can be used to control the formation of the metal droplets and their interaction while in flight from the discharge opening to the substrate. This will determine the deposition of the metal droplets on the substrate which, in turn, determines the cross-sectional shape of the non-uniform metal slab.

Figure 5:
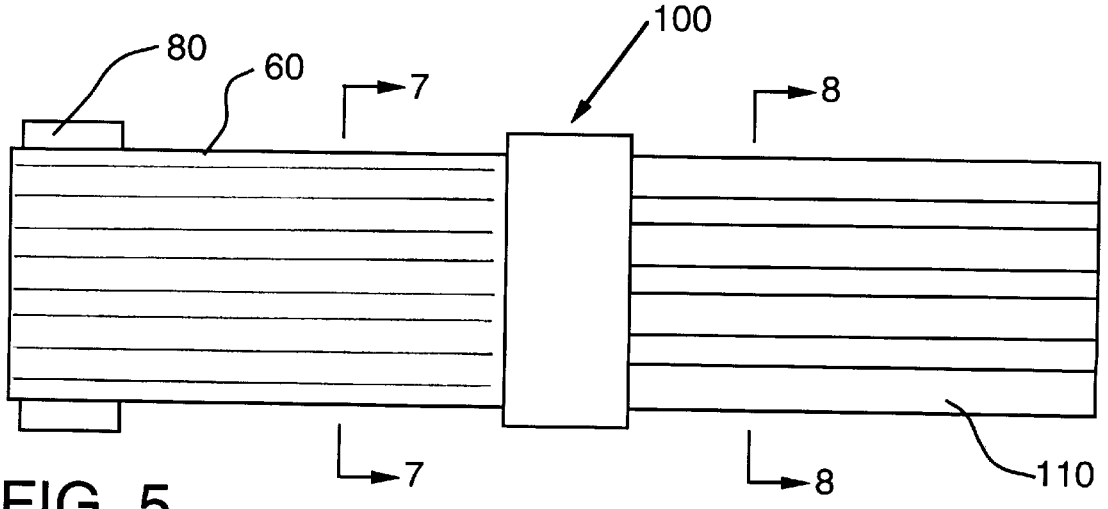
FIG. 5 shows a top plan schematic view of the shaped hot roll stand for converting the metal slab into the integrally stiffened metal structure of the invention.
Figure 6:
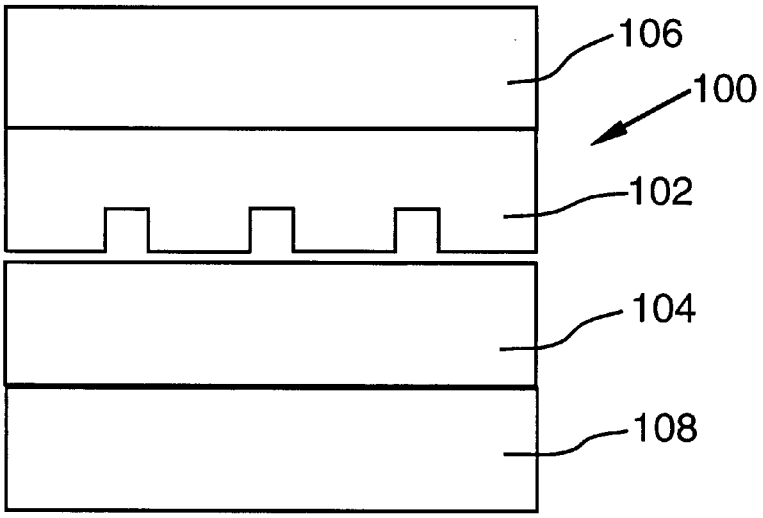
FIG. 6 is an elevational view of the mill stand shown in FIG. 5 showing the profile of the top roll.
Figure 7:
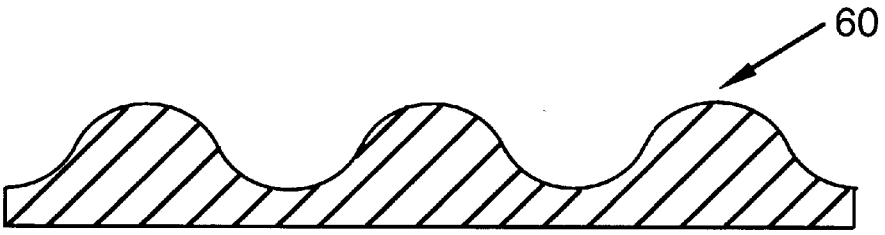
FIG. 7 is a cross-sectional view taken along line 7—7 of FIG. 5.
Figure 8:
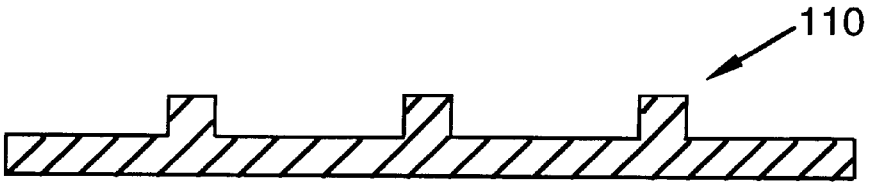
FIG. 8 is a cross-sectional view taken along line 8—8 of FIG. 5.

Referring now to FIGS. 5–8, the conversion of the metal slab 60 into the integrally stiffened metal structure 10 of the invention will be discussed. Referring particularly to FIG. 5, the metal slab 60 is unwound from the coil 80 on which it was wound after being spray cast and is fed into the nip of a shaped hot mill stand 100. The integrally stiffened metal structure 110 exits the hot mill stand and can be further processed, as by heat treating or shearing. As can be seen by FIG. 6, the shaped hot mill stand consists of a shaped roll 102 having a profile corresponding to the desired cross-sectional shape of the integrally stiffened metal structure 10 and a lower flat roll 104. Each roll 102, 104 has an associated back-up roll 106, 108. Referring to FIGS. 7 and 8, it will be appreciated that the metal slab 60 has a profile as shown in FIG. 7 which is then hot worked by the hot shaping mill 100 to produce an integrally stiffened metal structure 110 having a desired cross-sectional shape. This structure 110 has all the advantages of an integrally stiffened metal structure made by the prior art processes of extrusion and machining, but is made in a much more cost effective and efficient manner. Furthermore, by controlling the variables mentioned above, an infinite number of desired cross-sectional shapes can be easily produced, thus giving the process a flexibility not found in prior art processes.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of making a metal slab with a non-uniform cross-sectional shape comprising:

providing a movable substrate including an endless belt which orbits at least two rollers;

providing a spray casting apparatus including a plurality of spaced atomization nozzles, said nozzles each having a discharge opening;

introducing molten metal into said nozzles;

atomizing said molten metal as it is discharged from said nozzle through said discharge opening by subjecting said discharged molten metal to jets of an atomizing gas in order to form metal droplets;

depositing said metal droplets onto said endless belt; and controlling the deposition of said metal droplets on said movable substrate in order to form said metal slab with a non-uniform cross-sectional shape.

2. The method of claim 1, including controlling said deposition of said metal droplets onto said substrate by controlling (i) formation of said metal droplets at said discharge opening and (ii) interaction of said metal droplets between said discharge opening and said substrate.

3. The method of claim 2, including controlling said formation and interaction of said metal droplets by controlling the temperature of said molten metal introduced into said nozzle.

4. The method of claim 2, including controlling said formation and interaction of said metal droplets by controlling the pressure of said atomizing gas to which said discharged molten metal is subject.

5. The method of claim 1, including controlling the deposition of said metal droplets onto said substrate by varying the dimension of said discharge opening.

6. The method of claim 1, including positioning said nozzles in a straight line transversely across the width of said substrate; and controlling the cross-sectional shape of said metal slab by varying the distance between adjacent said nozzles.

7. The method of claim 6, including employing at least three nozzles.

8. The method of claim 1, wherein said atomizing gas is nitrogen or argon.

9. The method of claim 1, including employing as said molten metal an aluminum alloy.

10. A method of making an integrally stiffened metal structure comprising:

providing a movable substrate including an endless belt which orbits at least two rollers;

providing a spray casting apparatus including a plurality of spaced nozzles, each of said nozzles having a discharge opening;

introducing molten metal into said nozzles;

atomizing said molten metal as it is discharged from said discharge opening by subjecting said discharged molten metal to jets of an atomizing gas in order to form metal droplets;

depositing said metal droplets onto said endless belt;

controlling the deposition of said metal droplets on said movable substrate in order to form a metal slab having a non-uniform cross-sectional shape; and working said metal slab in order to form said integrally stiffened metal structure.

11. The method of claim 10, wherein said working comprises hot rolling.

12. The method of claim 11, wherein said hot rolling comprises employing a shaped roll in order to form said metal slab into said integrally stiffened metal structure.

13. The method of claim 10, including employing as said molten metal an aluminum alloy.

14. A method of making a metal slab with a non-uniform cross-sectional shape comprising:

providing a movable substrate including an endless belt which orbits at least two rollers;

providing a spray casting apparatus including at least one nozzle having a discharge opening;

introducing molten metal into said nozzle; and atomizing said molten metal as it is discharged from said nozzle through said discharge opening by subjecting said discharged molten metal to jets of an atomizing gas in order to form metal droplets; and depositing said metal droplets onto said endless belt in order to form said metal slab with a non-uniform cross-sectional shape.

15. The method of claim 14, including employing at least three nozzles.

16. The method of claim 15, including positioning said nozzles in a straight line transversely across the width of said movable substrate; and controlling the cross-sectional shape of said metal slab by varying the distance between adjacent said nozzles.

17. The method of claim 14, wherein said atomizing gas is nitrogen or argon.

18. The method of claim 14, including employing as said molten metal an aluminum alloy.

19. A method of making an integrally stiffened metal structure comprising:

providing a movable substrate including an endless belt which orbits at least two rollers;

providing a spray casting apparatus including at least one nozzle having a discharge opening;

introducing molten metal into said nozzle;

atomizing said molten metal as it is discharged from said discharge opening by subjecting said discharged molten metal to jets of an atomizing gas in order to form metal droplets;

depositing said metal droplets onto said endless belt in order to form a metal slab having a non-uniform cross-sectional shape; and working said metal slab in order to form said integrally stiffened metal structure.

20. The method of claim 19, wherein said working comprises hot rolling.

21. The method of claim 20, wherein said hot rolling comprises employing a shaped roll in order to form said metal slab into said integrally stiffened metal structure.

22. The method of claim 19, including employing as said molten metal an aluminum alloy.

* * * * *